US011201438B2

(12) United States Patent
Ho et al.

(10) Patent No.: US 11,201,438 B2
(45) Date of Patent: Dec. 14, 2021

(54) ELECTRICAL CONNECTOR WITH AN OUTER SHIELDING SHELL ROTATIVELY TO AN INNER SHELDING SHELL

(71) Applicant: LOTES CO., LTD, Keelung (TW)

(72) Inventors: Tung Ming Ho, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/819,280

(22) Filed: Mar. 16, 2020

(65) Prior Publication Data

US 2020/0313364 A1 Oct. 1, 2020

(30) Foreign Application Priority Data

Mar. 27, 2019 (CN) ..... 201910235131.0

(51) Int. Cl.
*H01R 13/6594* (2011.01)
*H01R 13/6587* (2011.01)
(Continued)

(52) U.S. Cl.
CPC ..... *H01R 13/6594* (2013.01); *H01R 13/6587* (2013.01); *H01R 24/64* (2013.01); *H01R 24/66* (2013.01); *H01R 12/716* (2013.01); *H01R 12/722* (2013.01); *H01R 12/724* (2013.01); *H01R 12/775* (2013.01); *H01R 12/88* (2013.01);
(Continued)

(58) Field of Classification Search
CPC ..... H01R 13/6594; H01R 13/6587; H01R 24/64; H01R 24/66; H01R 12/716; H01R 2107/00; H01R 13/6595; H01R 13/6581; H01R 12/724; H01R 13/6593; H01R 13/658; H01R 13/6583; H01R 12/722; H01R 13/641; H01R 12/775; H01R 12/88;
(Continued)

(56) References Cited

U.S. PATENT DOCUMENTS 10,424,876 B1 * 9/2019 Bandoh ..... H01R 13/648

FOREIGN PATENT DOCUMENTS

CN 101242735 B 9/2010
CN 102544812 A 7/2012
(Continued)

*Primary Examiner* — Abdullah A Riyami
*Assistant Examiner* — Justin M Kratt
(74) *Attorney, Agent, or Firm* — Locke Lord LLP; Tim Tingkang Xia, Esq.

(57) ABSTRACT

An electrical connector includes multiple terminals fixed to an insulating body. Each terminal has a contact portion electrically connected with a mating connector, and a conducting portion located behind the contact portion. The conducting portion extends out of the insulating body and is electrically connected with a circuit board. A grounding shell wraps outside the insulating body. A shielding shell rotates relative to the insulating body between a closed position and an open position. A first end of the shielding shell is electrically connected with the grounding shell. When the shielding shell is at the closed position, a second end of the shielding shell is electrically connected with at least one grounding medium electrically connected with the circuit board. When the shielding shell is at the open position, an observation window is formed between the shielding shell and the grounding medium to expose the conducting portions of the terminals.

20 Claims, 15 Drawing Sheets

(51) Int. Cl.

| | |
|---|---|
| ***H01R 24/64*** | (2011.01) |
| ***H01R 24/66*** | (2011.01) |
| *H01R 13/641* | (2006.01) |
| *H01R 13/6593* | (2011.01) |
| *H01R 13/6582* | (2011.01) |
| *H01R 13/6581* | (2011.01) |
| *H01R 12/72* | (2011.01) |
| *H01R 12/71* | (2011.01) |
| *H01R 12/77* | (2011.01) |
| *H01R 107/00* | (2006.01) |
| *H01R 12/88* | (2011.01) |
| *H01R 13/658* | (2011.01) |
| *H01R 13/6595* | (2011.01) |
| *H01R 13/648* | (2006.01) |
| *H01R 24/78* | (2011.01) |
| *H01R 13/6583* | (2011.01) |

(52) U.S. Cl.
CPC ..... *H01R 13/641* (2013.01); *H01R 13/6485* (2013.01); *H01R 13/658* (2013.01); *H01R 13/6581* (2013.01); *H01R 13/6582* (2013.01); *H01R 13/6583* (2013.01); *H01R 13/6593* (2013.01); *H01R 13/6595* (2013.01); *H01R 24/78* (2013.01); *H01R 2107/00* (2013.01)

(58) Field of Classification Search
CPC . H01R 13/6485; H01R 24/78; H01R 13/6582
USPC ..... 439/607.13, 607.27, 607.28, 607.35, 439/607.36, 607.37, 607.4, 607.47, 439/607.55, 607.56, 660, 676
See application file for complete search history.

(56) References Cited

FOREIGN PATENT DOCUMENTS

| | | | |
|---|---|---|---|
| CN | 105122560 | A | 12/2015 |
| CN | 103779732 | B | 10/2017 |
| CN | 108711697 | A | 10/2018 |

* cited by examiner

A–A

B–B

C–C

ELECTRICAL CONNECTOR WITH AN OUTER SHIELDING SHELL ROTATIVELY TO AN INNER SHELDING SHELL

CROSS-REFERENCE TO RELATED PATENT APPLICATION

This non-provisional application claims priority to and the benefit of, pursuant to 35 U.S.C. § 119(a), patent application Serial No. CN201910235131.0 filed in China on Mar. 27, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector for improving a high-frequency signal transmission effect.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has an insulating body and multiple terminals provided at the insulating body. Each terminal has a soldering portion extending out of the insulating body to solder with a circuit board. A shielding shell wraps the insulating body and is soldered to the circuit board. The soldering portion extends backward from the shielding shell and the insulating body. A front end of an auxiliary shielding cover is movably mounted at a rear end of the shielding shell. The auxiliary shielding cover may slide in a front-rear direction relative to the shielding shell, thereby forming a first position and a second position. The auxiliary shielding cover may slide backward from the first position to the second position, and may also slide forward from the second position to the first position.

When the auxiliary shielding cover is at the first position, the soldering portion is exposed to a rear end of the auxiliary shielding cover, which facilitate observation of a soldering condition. When the auxiliary shielding cover is at the second position, the soldering portion is shielded by the rear end of the auxiliary shielding cover, avoiding the signal interference.

However, with development of the electrical connector, frequencies of signals transmitted by the terminals are increasing. When the terminals transmit high-frequency signals, the phenomenon of impedance unbalance occurs to the soldering portions of the terminals. This is due to the capacitive induction generated by the high-frequency signal transmitted by the soldering portion and the rear end of the auxiliary shielding cover, a current is formed at the rear end of the auxiliary shielding cover, and the current is required to be transmitted forward to the shielding shell and further conducted to the circuit board, such that a grounding path of the current of the auxiliary shielding cover is relatively long. In the current transmission process, part of the current may be diverged and consumed around in the form of electromagnetic waves. If the grounding path is longer, more electromagnetic waves are diverged around, such that the high-frequency signal transmission of surrounding electronic components the electrical connector and the high-frequency transmission of the soldering portion are more affected, and impedance imbalance further occurs to the soldering portion.

Nevertheless, directly soldering the rear end of the auxiliary shielding cover to the circuit board to form a grounding loop may shorten the grounding path of the current of the auxiliary shielding cover. However, in such case, the auxiliary shielding cover may not be movably mounted at the rear end of the shielding shell, and the first position for observing the soldering portion may not be formed, thereby not ensuring a soldering effect of the soldering portion and the circuit board, and further affecting the signal transmission of the terminals.

Therefore, a heretofore unaddressed need to design a novel electrical connector exists in the art to address the aforementioned deficiencies and inadequacies.

SUMMARY

The present invention is directed to an electrical connector of which a shielding shell is electrically connected to a circuit board through a grounding medium arranged around a conducting portion, thereby shortening a grounding transmission path of the shielding shell.

To achieve the foregoing objective, the present invention adopts the following technical solutions.

An electrical connector is mated with a mating connector and mounted on a circuit board. The electrical connector includes: an insulating body; a plurality of terminals, fixed to the insulating body, wherein each of the terminals has a contact portion and a conducting portion located behind the contact portion, the contact portion is in electrical contact with the mating connector, and the conducting portion extends out of the insulating body and is in electrical contact with the circuit board; a grounding shell, provided to wrap outside the insulating body; and a shielding shell, rotating relative to the insulating body between a closed position and an open position, wherein a first end of the shielding shell is electrically conductively connected with the grounding shell. When the shielding shell is at the closed position, a second end of the shielding shell is electrically connected with at least one grounding medium, and the grounding medium is mounted on and electrically conductively connected with the circuit board. When the shielding shell is at the open position, an observation window is formed between the shielding shell and the grounding medium, and the conducting portion of each of the terminals is exposed through the observation window.

In certain embodiments, the grounding medium has a mounting portion mounted on the circuit board, a matching portion extends upward from the mounting portion to be electrically connected to the second end, the second end is concavely provided with a notch corresponding to the mounting portion, and when the shielding shell is at the closed position, the notch accommodates the mounting portion.

In certain embodiments, the shielding shell has two protruding portions located at two sides of the notch, the two protruding portions are located at two sides of the mounting portion respectively when the shielding shell is at the closed position, and a bottom surface of the mounting portion, a bottom surface of the conducting portion of each of the terminals and a bottom surface of each of the protruding portions are located on a same horizontal plane.

In certain embodiments, when the shielding shell is at the open position, the observation window is formed between the matching portion and an inner wall of the notch, and the grounding shell is partially exposed through the observation window.

In certain embodiments, the matching portion has at least one elastic slot, and when the shielding shell is at the closed position, the elastic slot is higher than the notch.

In certain embodiments, the matching portion is electrically connected with the shielding shell to form a contact position, the mounting portion has a through hole running therethrough in a vertical direction, and the through hole is located below the contact position.

In certain embodiments, the grounding medium is provided behind the insulating body, a separation space is provided between the insulating body and the grounding medium, at least one of the conducting portions of the terminals is located in the separation space, the shielding shell has a top wall, two side walls and a rear wall, the top wall shields an upper side of the separation space, the two side walls shield a left side and a right side of the separation space respectively, the rear wall and the grounding medium altogether shield a rear side of the separation space, and the top wall, the two side walls, the rear wall and the grounding medium altogether enclose the separation space.

In certain embodiments, at least one of the side walls forms the first end to electrically abut and match with the grounding shell, and the rear wall forms the second end to be in electrical contact with the grounding medium.

In certain embodiments, the grounding shell has two first pins respectively at a left side and a right side of the grounding shell, the two first pins are located between the two side walls, and each of the first pins is electrically conductively connected with a corresponding one of the side walls.

In certain embodiments, the grounding shell has two second pins respectively at a left side and a right side of the grounding shell, and the second pins are located in front of the side walls and respectively at a left side and a right side of the contact portion.

In certain embodiments, the grounding shell has a back plate, and the back plate is located between the top wall and the conducting portions of the terminals and is configured to shield the conducting portions of the terminals at an upper side thereof.

In certain embodiments, two grounding media are provided and located at two sides of a rear portion of the conducting portions of the terminals, the shielding shell has two side walls provided opposite to each other in a left-right direction, a front end of each of the side walls forms the first end to be in electrical contact with the grounding shell, and a rear end of each of the side walls forms the second end to be in electrical contact with each of the two grounding media.

In certain embodiments, two pivoting portions are provided at the two first ends of the shielding shell, and the two pivoting portions are pivoted to a left side and a right side of the grounding shell respectively.

In certain embodiments, the grounding shell has an inner metal shell and an outer metal shell, the inner metal shell wraps the insulating body, the outer metal shell is provided outside the inner metal shell, and the shielding shell is provided outside the outer metal shell.

In certain embodiments, the inner metal shell and the outer metal shell are soldered and fixed to form at least one first soldering point, the shielding shell has two side walls at a left side and a right side of the shielding shell respectively, each of the side walls abuts the outer metal shell, and the side walls and the first soldering point are located on a first vertical plane in a left-right direction.

In certain embodiments, the insulating body has a tongue, the contact portion is exposed to the tongue, the inner metal shell surrounds the tongue to form an insertion space, the inner metal shell has a breaking hole, an elastic abutting arm is formed by extending from an inner wall of the breaking hole toward the insertion space to electrically abut a shielding outer shell of the mating connector, the grounding medium has a matching portion in electrical contact with the shielding shell, and the matching portion, the elastic abutting arm and the breaking hole are located on a second vertical plane in a front-rear direction.

In certain embodiments, at least one rigid protrusion portion is formed by protruding from the inner metal shell toward the insulating body to abut a shielding outer shell of the mating connector, the outer metal shell has two conductive legs located at a left side and a right side of the contact portions of the terminals respectively, the inner metal shell and the outer metal shell are soldered and fixed to form at least one second soldering point, and the rigid protrusion portion, the conductive legs and the second soldering point are located on a third vertical plane in a left-right direction.

In certain embodiments, the outer metal shell has a first hole running therethrough in a vertical direction, the shielding shell has an elastic sheet extending forward, the elastic sheet is provided across the first hole downward from top thereof, a tail end of the elastic sheet is provided below the outer metal shell, the shielding shell rotates along the elastic sheet in a front-rear direction, and when the shielding shell rotates in the front-rear direction, the elastic sheet rotates in the first hole in the first-rear direction.

In certain embodiments, the inner metal shell has a second hole accommodating the tail end of the elastic sheet.

In certain embodiments, the grounding medium is located behind the conducting portions of the terminals, and a projection of each of the conducting portions of the terminals in a front-rear direction overlaps with a projection of the grounding medium in the front-rear direction.

Compared with the related art, the grounding medium is provided at an interval behind the conducting portions, and the shielding shell rotates relative to the insulating body between the open position and the closed position. When the shielding shell is at the open position, an observation window is formed between a rear end of the shielding shell and the grounding medium, and a conducting portion is exposed to the observation window, such that the line of sight may focus on the observation window, reducing the interference of the surrounding electronic components to the line of sight, and further facilitating observation about whether the conducting portion is properly soldered or not, thereby ensuring a soldering effect of the conducting portion, and facilitating signal transmission of the terminals. When the shielding shell is at the closed position, the shielding shell is conductively connected with the grounding medium, such that a current generated at the shielding shell may be conducted to the circuit board through the grounding medium, shortening a grounding path thereof, ensuring an isolation and shielding effect of the rear end of the shielding shell and the grounding medium on the conducting portion, and reducing the influence between signal transmission of the terminals and signal transmission of the surrounding electronic components.

Further compared with the related art, the grounding medium has a mounting portion mounted at the circuit board, the second end is concavely provided with a notch corresponding to the mounting portion, and when the shielding shell is at the closed position, the notch accommodates the mounting portion. Two protruding portions are provided at two sides of the notch. When the shielding shell is at the closed position, the notch is reserved to accommodate the mounting portion, the two protruding portions are located at two sides of the mounting portion, and are located on a same horizontal plane with a bottom surface of the conducting portion of each of the terminals, such that the conducting portions of the terminals may abut the circuit board better, achieving a better sealing and shielding effect on the conducting portions.

Further compared with the related art, when the shielding shell is at the open position, the observation window is formed between the matching portion and an inner wall of the notch, such that the line of sight may focus on the observation window, reducing the interference of the surrounding electronic components to the line of sight. The grounding shell is partially exposed through the observation window, allowing convenient observation of whether part of the grounding shell is mounted accurately or not.

Further compared with the related art, the matching portion has the elastic slot, which is configured to improve elasticity of the matching portion when the shielding shell is at the closed position, ensuring closer connection between the matching portion and the second end, facilitating shortening of a contact circuit therebetween, and thereby facilitating transmission of the current at the shielding shell. The elastic slot is higher than the notch, facilitating a shielding effect of the rear wall and the grounding medium on the conducting portion. If the elastic slot is downward concavely provided to be lower than the notch, the notch is formed opposite to the elastic slot to form a leakage opening, causing signals of the conducting portions to leak outside or signals of the surrounding electronic components to interfere with the signal transmission of the conducting portion through the leakage opening. For the foregoing deficiency, the elastic slot is higher than the notch, avoiding from the formation of the signal leakage opening, improving the shielding effect of the shielding shell on the conducting portions, and facilitating high-frequency signal transmission.

Further compared with the related art, the matching portion is electrically connected with the shielding shell to form a contact position, the mounting portion has a through hole running therethrough in a vertical direction, and when the shielding shell is at the closed position, the through hole is located below the contact position, such that transmission of the current flowing to the mounting portion to the circuit board through an inner surface of the through hole is facilitated when the current of the shielding shell is transmitted to the matching portion, shortening the grounding transmission path.

Further compared with the related art, the top wall, the two side walls, the rear wall and the grounding medium altogether enclose the separation space, facilitating isolation and shielding of the conducting portions from the surrounding electronic components, and facilitating respective high-frequency signal transmission.

Further compared with the related art, the rear wall forms the second end to be in electrical contact with the grounding medium, facilitating direct conduction of the current generated at the rear wall to the circuit board through the grounding medium, and shortening the grounding path of the current generated at the rear wall.

Further compared with the related art, the two first pins are located between the two side walls, and each of the first pins is electrically conductively connected with a corresponding one of the side walls, thereby increasing the grounding connection points between the grounding shell and the shielding shell, equivalently increasing channels through which the current flows to the circuit board, facilitating fast transmission of the current to the circuit board, and reducing the possibility of interference to high-frequency signals.

Further compared with the related art, the second pins are located at two sides of the contact portion, which may transmit the current surrounding the contact portion the circuit board fast, thus reducing the possibility of interference to the high-frequency signals. The second pins are located in front of the side walls, such that the current on the side walls may be transmitted to the second pins in a manner of locating on the same vertical plane, shortening the grounding transmission path of the current, and further reducing the possibility of interference to the high-frequency signals.

Further compared with the related art, the back plate is located between the top wall and the conducting portions of the terminals and is configured to shield the conducting portions of the terminals at an upper side thereof. Since the shielding shell rotates relative to the outer metal shell, when the shielding shell is at the closed position, there may be a clearance between the top wall and the grounding shell or the insulating body, and if there is no shielding object between the conducting portions and the top wall, electromagnetic waves of the conducting portion may leak from the clearance, affecting signal transmission of the surrounding electronic components.

Further compared with the related art, the side walls abut the outer metal shell, and the side walls and the first soldering point are located on a first vertical plane in the left-right direction. Since the shielding shell may rotate upward, when the shielding shell moves upward and away from the outer metal shell, the shielding shell applies an upward acting force to the outer metal shell. Further, the first soldering point and the two side walls are located on the same first vertical plane, such that the upward acting force of the shielding shell on the outer metal shell and a fixation force of the first soldering point on the outer metal shell are located on the same plane, facilitating stable mounting of the outer metal shell.

Further compared with the related art, the matching portion, the elastic abutting arm and the breaking hole are located on a second vertical plane in the front-rear direction, such that the current flowing through the elastic abutting arm may be transmitted to the matching portion in the manner of locating on the same vertical plane, facilitating faster flowing of the current to the circuit board, and reducing the influence of the current on the grounding shell on high-frequency signal transmission.

Further compared with the related art, the rigid protrusion portion, the conductive legs and the second soldering point are located on a third vertical plane in the left-right direction, such that the transmission path of the current of the shielding shell is located on the same vertical plane, shortening the grounding transmission path for transmission of the current of the shielding shell to the conductive legs, reducing the electromagnetic waves diverged in a transmission process, and facilitating signal transmission of the terminals.

Further compared with the related art, the grounding medium is located behind multiple conducting portions, and the projection of each conducting portion in the front-rear direction overlaps with the projection of the grounding medium in the front-rear direction, such that the rear portion of each conducting portion is shielded by the grounding medium, facilitating shielding of the high-frequency signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
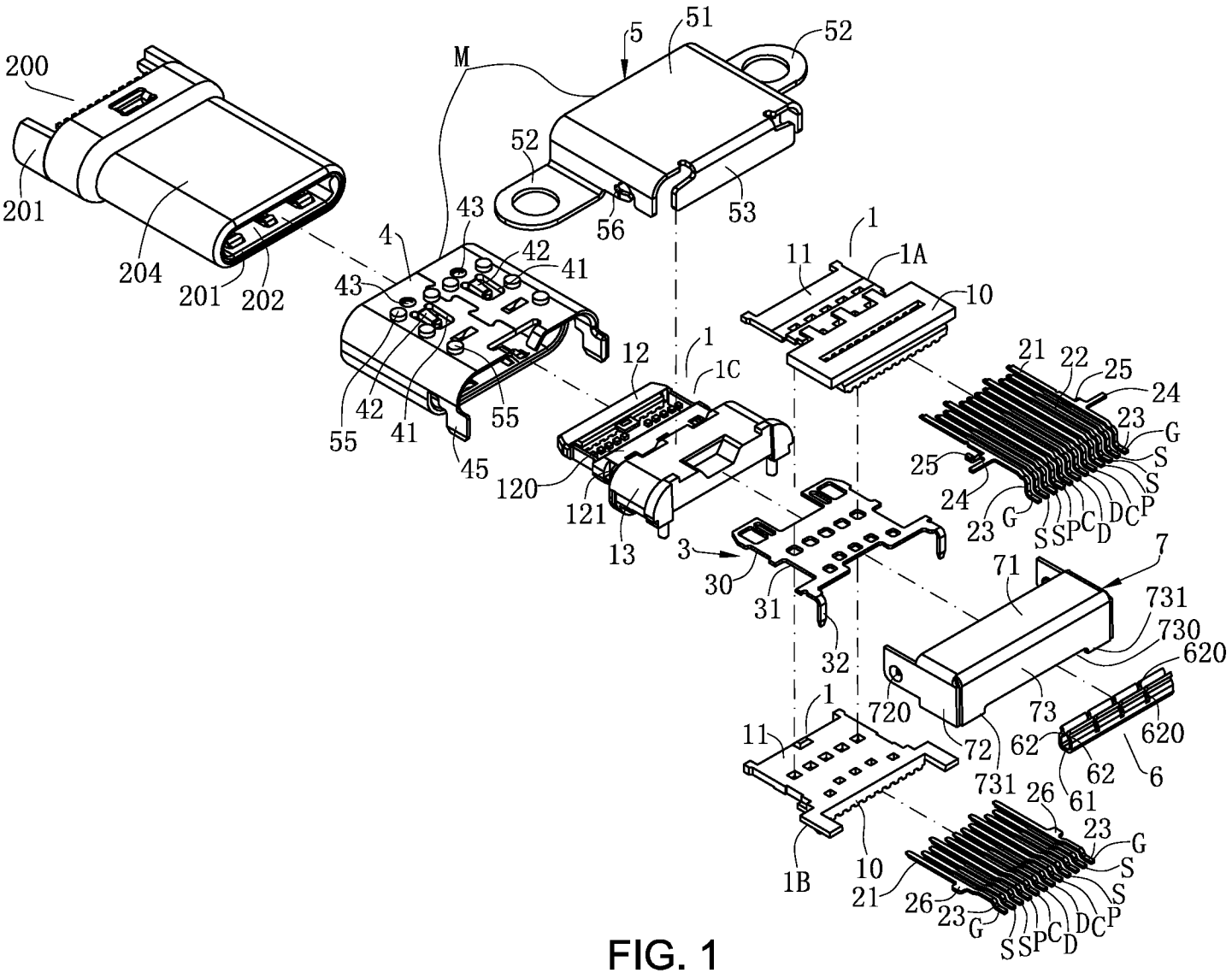
FIG. 1 is a perspective exploded view of an electrical connector and a plug connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-15. In accordance with the purposes of this invention, as embodied and broadly described herein, this invention, in one aspect, relates to an electrical connector.

Figure 2:
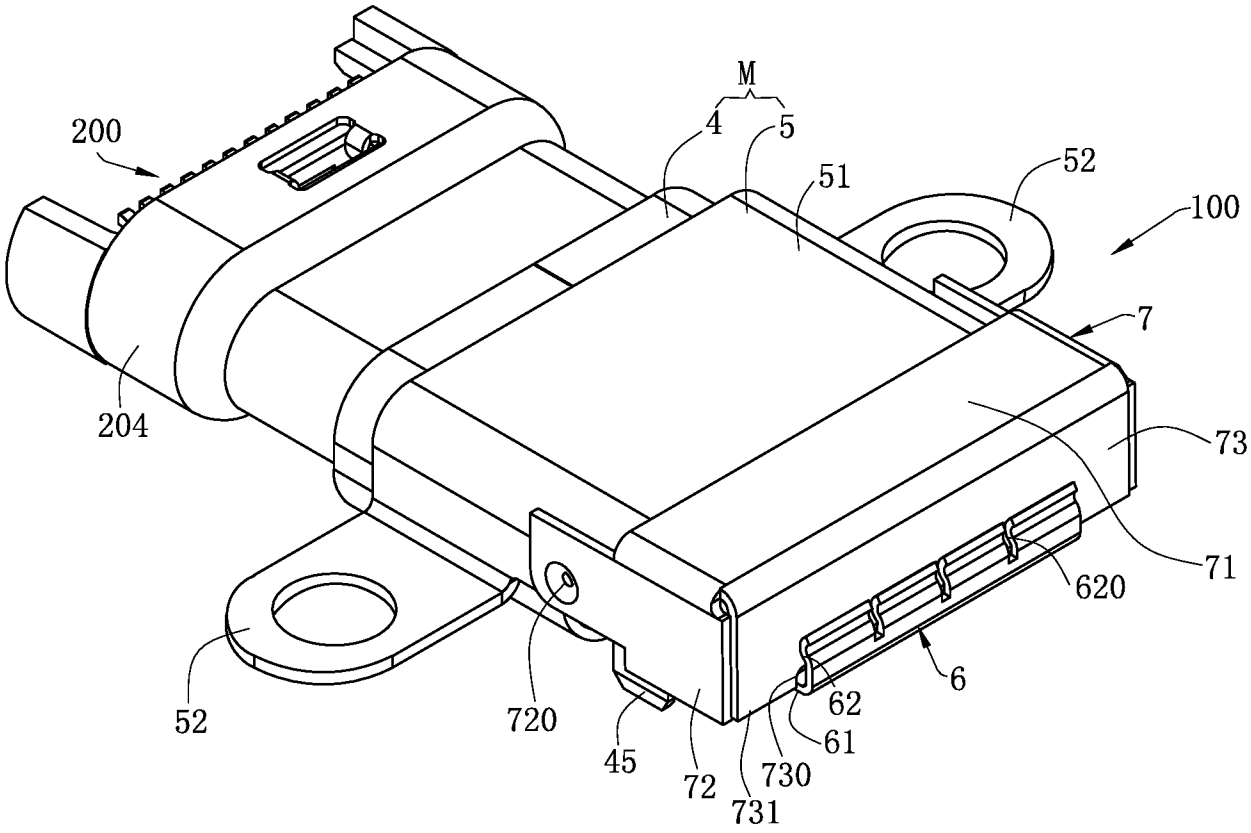
FIG. 2 is a perspective assembly view of the electrical connector and the plug connector according to the first embodiment of the present invention.
Figure 3:
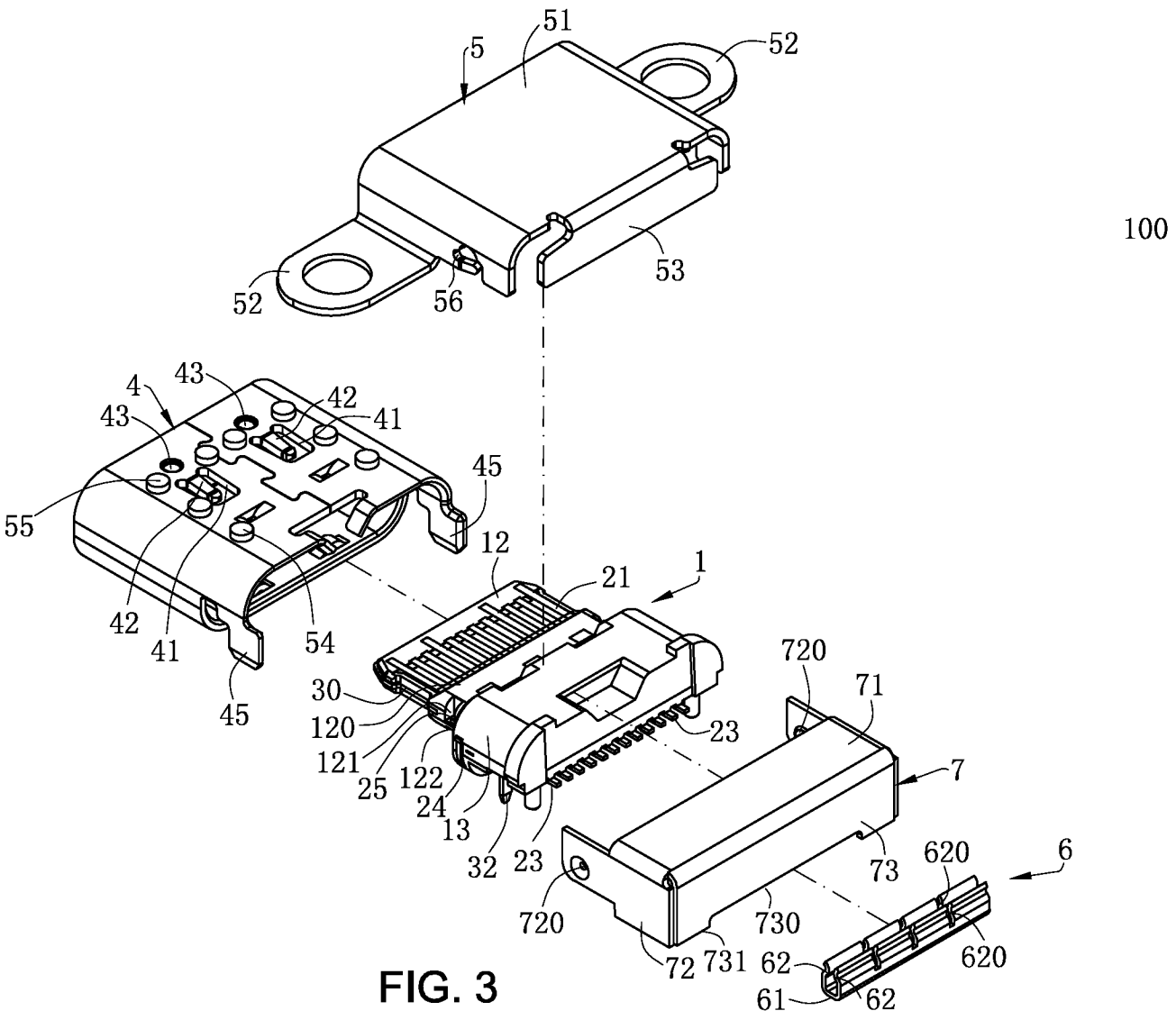
FIG. 3 is a perspective exploded view of the electrical connector according to the first embodiment of the present invention.

Referring to FIG. 1, FIG. 2 and FIG. 3, a first embodiment of an electrical connector 100 according to the present invention is shown. In this embodiment, the electrical connector 100 is a type-C socket connector, which is mounted on a circuit board 300 and mates with a plug connector 200.

The plug connector 200 has a plastic body 201, and the plastic body 201 has an accommodating cavity 202. Elastic contacts 203 in upper and lower rows are fixed in the plastic body 201 and exposed to the accommodating cavity 202, and are in electrical contact with the electrical connector 100. A grounding sheet (not shown in the figures) is fixed at the plastic body 201 and located between the elastic contacts 203 in the upper and lower rows. Each of left and right sides of the grounding sheet (not shown) has two snap-fit portions (not shown) respectively exposed to left and right sides of the accommodating cavity 202. A shielding shell 204 wraps the plastic body 201.

Figure 6:
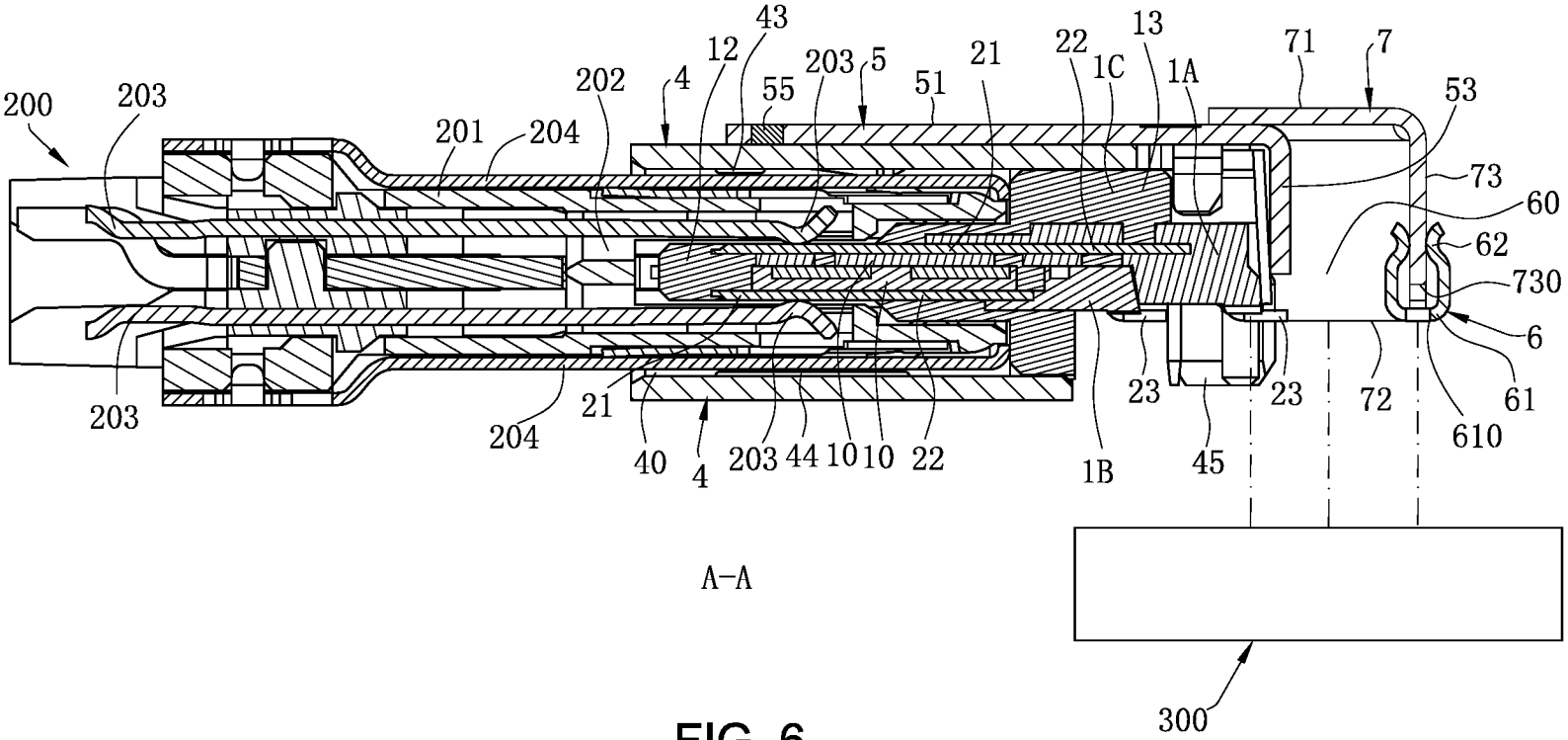
FIG. 6 is a sectional view of the electrical connector in FIG. 5 along line A-A.

Referring to FIG. 1, FIG. 2 and FIG. 6, the electrical connector 100 has multiple terminals 2. The terminals 2 are fixed on an insulating body 1, and the insulating body 1 is provided inside a grounding shell M. A grounding medium 6 is mounted on the circuit board 300 and provided at an interval behind the insulating body 1. A shielding shell 7 is movably mounted at the grounding shell M, and rotates relative to the insulating body 1 in a front-rear direction.

Figure 8:
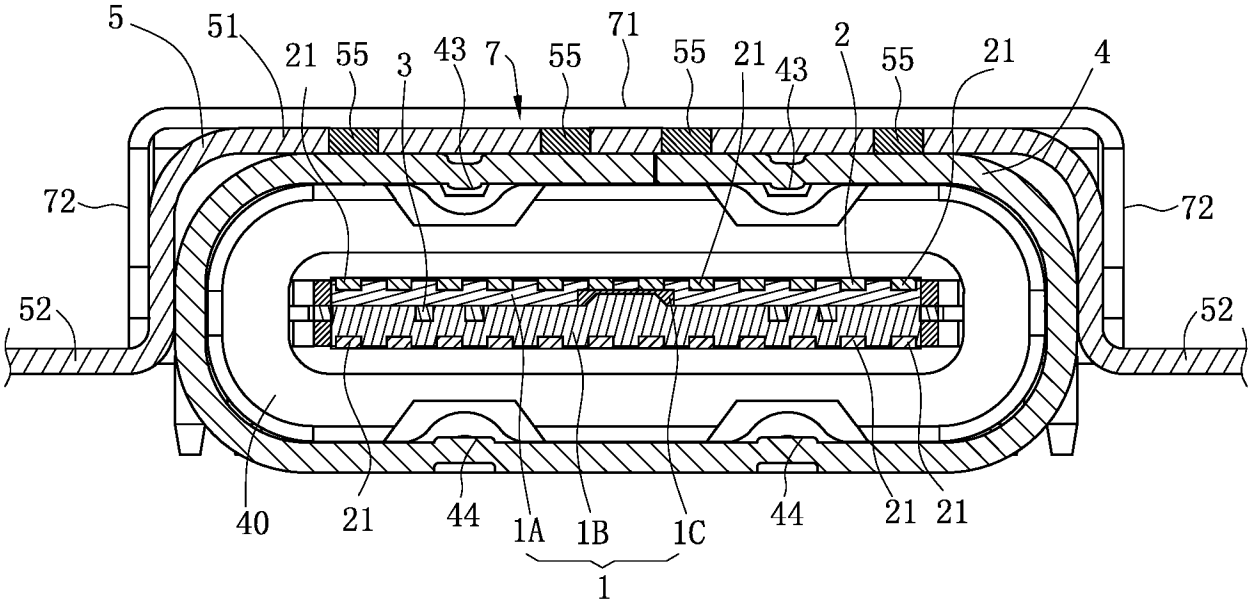
FIG. 8 is a sectional view of the electrical connector in FIG. 7 along line B-B.

Referring to FIG. 1, FIG. 3 and FIG. 8, each terminal 2 has a contact portion 21 elastically mating with a corresponding elastic contact 203, a connecting portion 22 horizontally extending backward from the contact portion 21, and a conducting portion 23 bending downward and extending from the connecting portion 22 and soldered to a surface of the circuit board 300. The terminals 2 are arranged in two rows in a vertical direction, thereby forming contact portions 21 in an upper row and a lower row and connecting portions 22 in the upper row and the lower row. However, the conducting portions 23 bend downward, so the conducting portions 23 of the terminals 2 in the upper row and the conducting portions 23 of the terminals 2 in the lower row are arranged in a front row and a back row in the front-rear direction. The conducting portions 23 in the front row and the conducting portions 23 in the back row are staggered in the front-rear direction, and a conducting portion 23 in the front row may be observed between each two adjacent conducting portions 23 in the back row. The terminals 2 in each row includes, respectively from left to right, a ground terminal G, a pair of differential signal terminals S, a power terminal P, a reserved terminal C, a pair of low-speed signal terminals D, a reserved terminal C, a power terminal P, a pair of differential signal terminals S and a ground terminal G. Referring to FIG. 8, the contact portions 21 in the upper and lower rows are provided symmetrically at 180° along a virtual center line in the front-rear direction. Each ground terminal G in the upper row has a fastening portion 24 horizontally protruding in a left-right direction and an upper extending arm 25 extending downward and forward from a front end of the fastening portion 24. Each ground terminal G in the lower row has a lower extending arm 26 horizontally protruding in the left-right direction, and a tail end of the upper extending arm 25 downward abuts an upper surface of a corresponding lower extending arm 26.

Referring to FIG. 1 and FIG. 3, a middle shielding sheet 3 is located between the terminals 2 in the upper and lower rows, and is equally distanced from each contact portion 21 in the vertical direction, facilitating impedance balance of the terminals 2. The left and right sides of the middle shielding sheet 3 have two snap-fit slots 30 configured to be fastened with the snap-fit portions (not shown), thereby forming a grounding transmission path. The left and right sides of the middle shielding sheet 3 have two slots 31 located behind the snap-fit slots 30 respectively. Each upper extending arm 25 downward abuts a corresponding lower extending arm 26 across the slot 31 at the corresponding side. Two pins 32 bend downward and extend from a rear end of the middle shielding sheet 3 to be conductively connected with a ground loop of the circuit board 300.

Referring to FIG. 1, FIG. 3 and FIG. 6, the insulating body 1 has an upper injection molding member 1A, a lower injection molding member 1B, and an outer injection molding member 1C wrapping the upper injection molding member 1A and the lower injection molding member 1B. The upper injection molding member 1A and the terminals 2 in the upper row are integrally formed by a primary injection molding. Meanwhile, the terminals 2 in the lower row, the middle shielding sheet 3 and the lower injection molding member 1B are also integrally formed by the primary injection molding. After the primary injection molding is completed, the upper injection molding member 1A and the lower injection molding member 1B are assembled together vertically. The upper injection molding member 1A and the lower injection molding member 1B altogether form an inner base 10 and an inner tongue sheet 11 provided at a front end of the inner base 10. The contact portions 21 in the upper and lower rows are exposed to upper and lower plate surfaces of the inner tongue sheet 11. The connecting portions 22 in the upper and lower rows are embedded in the inner base 10. The conducting portions 23 in the front and back rows are partially embedded in the inner base 10, and each conducting portion 23 extends downward from a lower surface of the inner base 10.

Referring to FIG. 1, FIG. 3 and FIG. 6, after the upper injection molding member 1A and the lower injection molding member 1B are assembled, a secondary injection molding is performed, thereby implementing wrapping of the upper injection molding member 1A and the lower injection molding member 1B with the outer injection molding member 1C. The upper injection molding member 1A, the lower injection molding member 1B and the outer injection molding member 1C altogether form the insulating body 1. The outer injection molding member 1C wraps the inner tongue sheet 11 to form a tongue 12, and wraps the inner base 10 to form a base 13 located behind the tongue 12. A rear end of the tongue 12 has a step portion 120 connected with the base 13. A thickness of the step portion 120 is increased in the vertical direction relative to other portions of the tongue 12. Two first positioning slots 121 are concavely provided on an upper surface of the step portion 120 and located at left and right sides of the step portion 120 respectively. The tail end of each upper extending arm 25 is exposed to the first positioning groove 121 at the corresponding side, such that the tail end of the upper extending arm 25 may be positioned by a tool in the secondary injection molding process, preventing the tail end from being deflected by an insulating material forming the outer injection molding member 1C. Two second positioning slots 122 are concavely provided on a lower surface of the step portion 120 and located at the left and right sides of the step portion 120, and each second positioning slot 122 is formed opposite to a corresponding first positioning slot 121 vertically. Each lower extending arm 26 is exposed in a corresponding second positioning slot 122, such that the lower extending arm 26 may be positioned by the tool in the secondary injection molding process, preventing it from being deflected by the insulating material forming the outer injection molding member 1C. Therefore, the upper extending arm 25 may firmly abut the lower extending arm 26.

Referring to FIG. 1, FIG. 3 and FIG. 6, the contact portions 21 in the upper and lower rows are exposed to upper and lower plate surfaces of the tongue 12, and the two snap-fit slots 30 are exposed to left and right side surfaces of the tongue 12 respectively. The connecting portions 22 in the upper and lower rows are embedded in the step portion 120 and the base 130. Each fastening portion 24 protrudes out of a side surface of the base 13 to be in contact with the grounding shell M. The conducting portions 23 in the front and back rows are embedded in the base 13, and each conducting portion 23 extends downward out of a lower surface of the base 13. The conducting portions 23 in the back row extend backward from a rear surface of the insulating body 1. The pins 32 extend downward out of the lower surface of the base 13 to be soldered with the circuit board 300.

Referring to FIG. 1 and FIG. 3, the grounding shell M has an inner metal shell 4 and an outer metal shell 5 covering the inner metal shell 4. A front portion of the inner metal shell 4 surrounds the tongue 12. An insertion space 40 is formed between the tongue 12 and the inner metal shell 4 to be mated with the plug connector 200. A rear portion of the inner metal shell 4 wraps the base 13 and abuts the fastening portions 24. The tongue 12 and an opening of the insertion space 40 are 180° symmetrical along the virtual center line in the front-rear direction. Since the contact portions 21 in the two rows are symmetrical along the virtual center line in the front-rear direction, the plug connector 200 may be normally and reversely inserted into the electrical connector 100.

Referring to FIG. 1, FIG. 6 and FIG. 8, an upper wall surface of the inner metal shell 4 has two breaking holes 41 running therethrough and two elastic abutting arms 42. Each elastic abutting arm 42 extends backward from a front wall of the corresponding breaking hole 41 toward the insertion space 40 and abuts the shielding shell 204. The inner metal shell 4 further has two upper rigid protrusion portions 43 and two lower rigid protrusion portions 44. The upper rigid protrusion portions 43 protrude from the upper wall surface of the inner metal shell 4 toward the insertion space 40. The lower rigid protrusion portions 44 protrude from the lower wall surface of the inner metal shell 4 toward the insertion space 40. The upper rigid protrusion portions 43 and the lower rigid protrusion portions 44 are provided opposite to each other vertically to abut the shielding shell 204 in the vertical direction.

Referring to FIG. 3 and FIG. 6, the inner metal shell 4 has two first pins 45 located at left and right sides of a rear end of the inner metal shell 4 respectively to conductively connect a current of the inner metal shell 4 to the circuit board 300 to form the grounding transmission path. The two first pins 45 are located at left and right sides of the base 13. Since the connecting portions 22 and conducting portions 23 of the terminals 2 are provided in the base 13, the rear end of the inner metal shell 4 wraps the base 13, and capacitive induction is generated between the connecting portions 22, the conducting portions 23 and rear end of the inner metal shell 4, thereby generating the current at the rear end of the inner metal shell 4. If the first pins 45 are not provided at the rear end of the inner metal shell 4 and located in the vicinity of the base 13, the current at the rear end of the inner metal shell 4 may be diverged and consumed around in the form of electromagnetic wave to adversely affect high-frequency signal transmission of the terminals 2.

Figure 4:
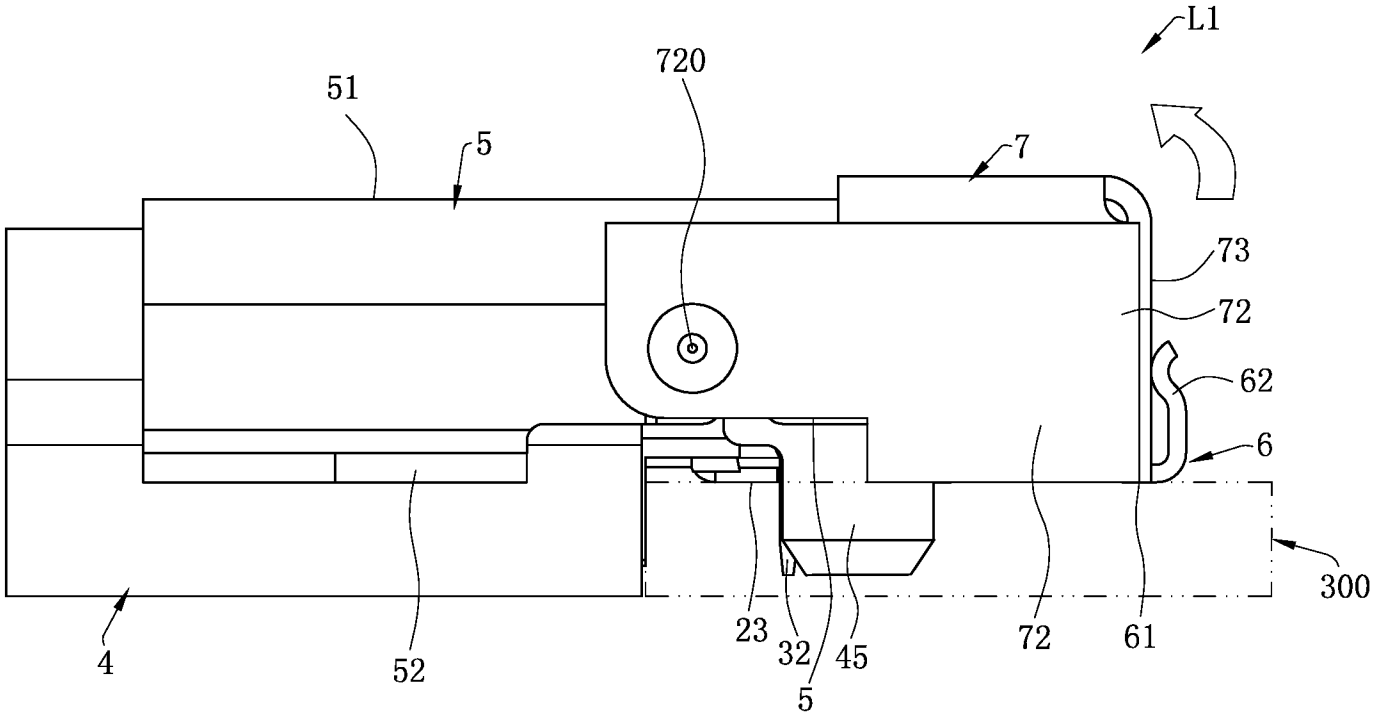
FIG. 4 is a side plain view of the electrical connector at a closed position according to the first embodiment of the present invention.

Referring to FIG. 3, FIG. 4 and FIG. 6, the outer metal shell 4 has an upper plate 51, two second pins 52 bending downward and extending from two sides of the upper plate 51, and a back plate 53 bending downward and extending from a rear edge of the upper plate 51. The back plate 53 covers a rear end face of the insulating body 1, and is located above the conducting portions 23 in the back row to improve a shielding effect on the terminals 2. The outer metal shell 5 further has two pivoting holes 56 located at left and right sides of the outer metal shell 5 and in front of the first pins 45.

Figure 7:
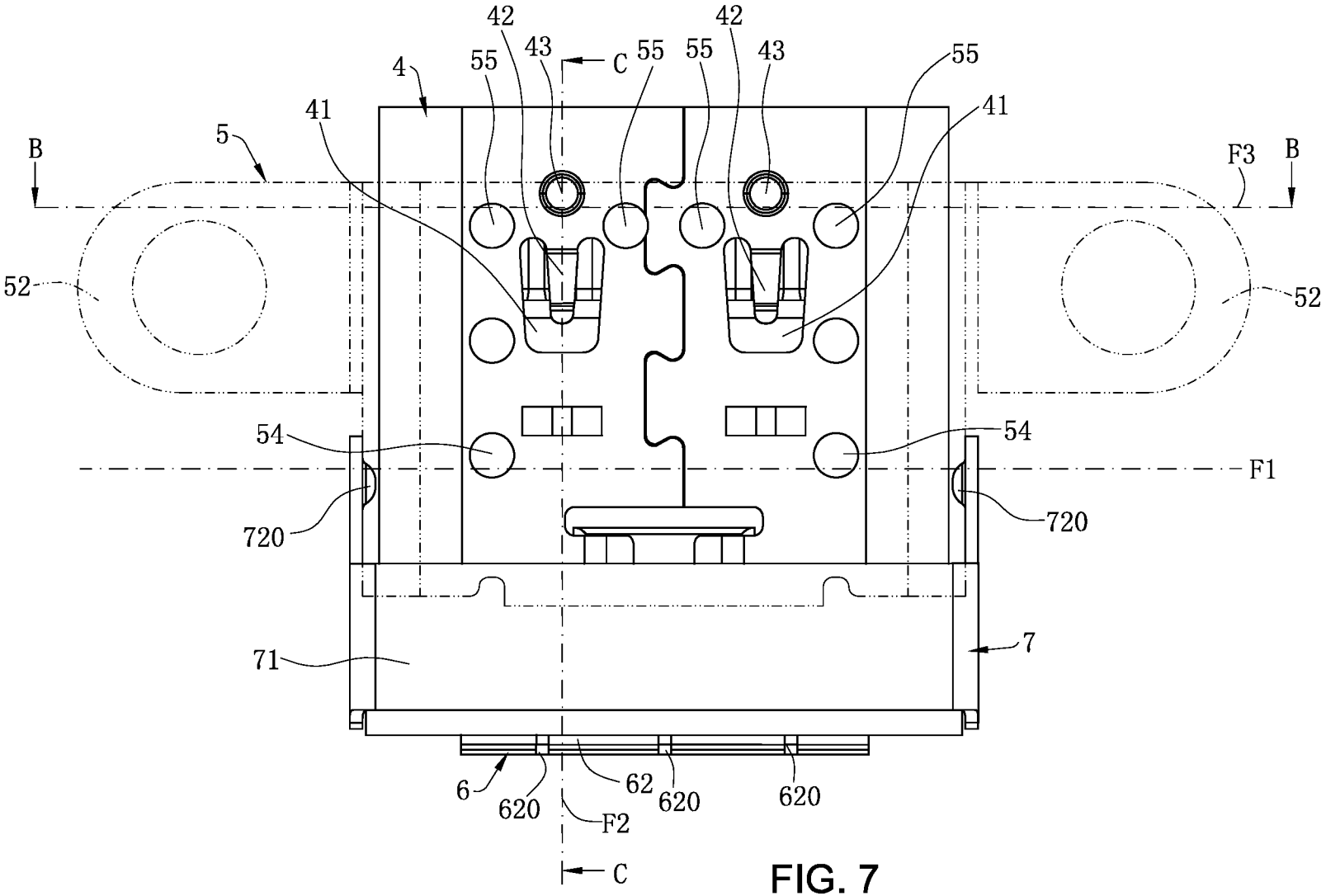
FIG. 7 is a top plain view of the electrical connector at the closed position according to the first embodiment of the present invention.

Referring to FIG. 6, FIG. 7 and FIG. 8, the two conductive legs 52 are located at left and right sides of the insertion space 40 respectively to transmit the current of the outer metal shell 5 to the circuit board 300, thereby forming the grounding transmission path. The conductive legs 52 are located in front of the pivoting holes 56. The upper plate 51 is closely attached to the upper wall surface of the inner metal shell 4, and the upper plate 51 shields the breaking holes 41 and the elastic abutting arms 42. The upper plate 51 is soldered and fixed with the upper wall surface of the inner metal shell 4 to form multiple first soldering points 54 and multiple second soldering points 55. The second soldering points 55, the conductive legs 52, the upper rigid protrusion portions 43 and the lower rigid protrusion portions 44 are all located on a third vertical plane F3 in the left-right direction. The upper rigid protrusion portions 43 and the lower rigid protrusion portions 44 abut the shielding shell 204, and the current on the shielding shell 204 is transmitted to the upper rigid protrusion portions 43 and the lower rigid protrusion portions 44 so as to be transmitted to the inner metal shell 4. The current is transmitted from the inner metal shell 4 to the outer metal shell 5 through the first soldering points 54 and the second soldering points 55, and then the current is transmitted to the circuit board 300 through the conductive legs 52. In the present embodiment, the second soldering points 55, the conductive legs 52, the upper rigid protrusion portions 43 and the lower rigid protrusion portions 44 are all located on the third vertical plane F3 in the left-right direction, ensuring transmission of the current to the circuit board 300 in a manner of locating on the same vertical plane and shortening the grounding transmission path for transmission of the current of the shielding shell 204 to the conductive legs 52, thereby ensuring faster transmission of the current to the circuit board 300, reducing electromagnetic waves formed and diverged by the current in the transmission process, and further facilitating high-frequency signal transmission of the terminals 2.

Figure 5:
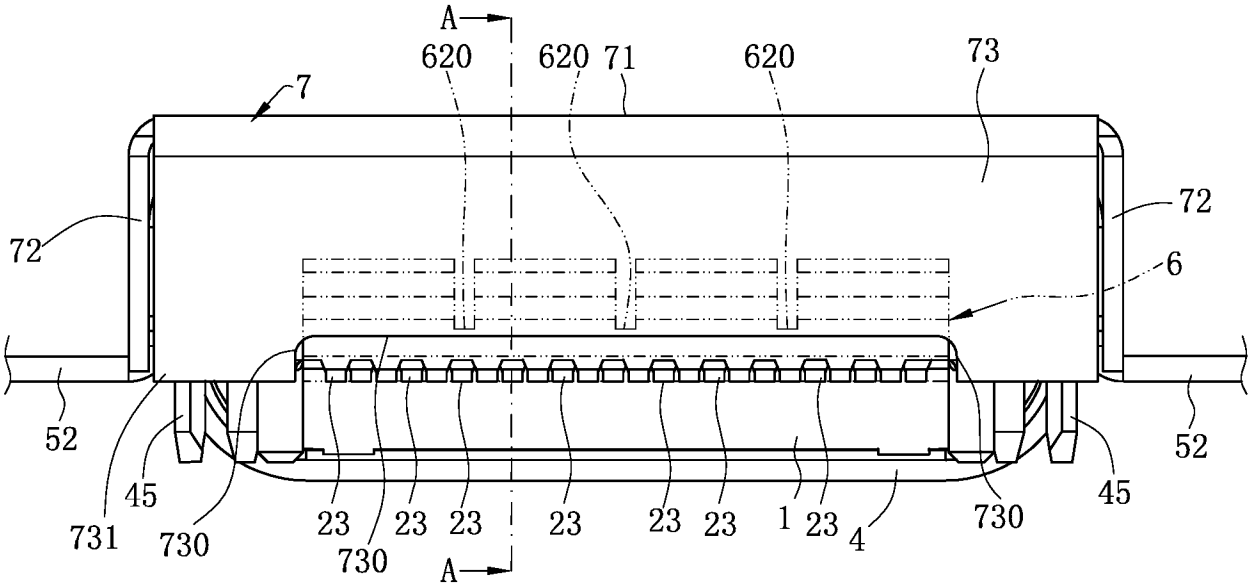
FIG. 5 is a rear plain view of the electrical connector at the closed position according to the first embodiment of the present invention.

Referring to FIG. 1, FIG. 5 and FIG. 6, a separation space 60 is formed between the grounding medium 6 and the insulating body 1, and the conducting portions 23 in the back row and the back plate 53 are located in the separation space 60. The grounding medium 6 has a mounting portion 61 soldered to the circuit board 300, and the mounting portion 61 has multiple through holes 610 running therethrough in the vertical direction. Two matching portions 62 are provided opposite to each other in the front-rear direction and extend upward from the mounting portion 61 to clamp the shielding shell 7. The matching portions 62 are elastic, and each matching portion 62 has multiple elastic slots 620 upward concavely provided to improve elasticity of the matching portion 62.

Figure 10:
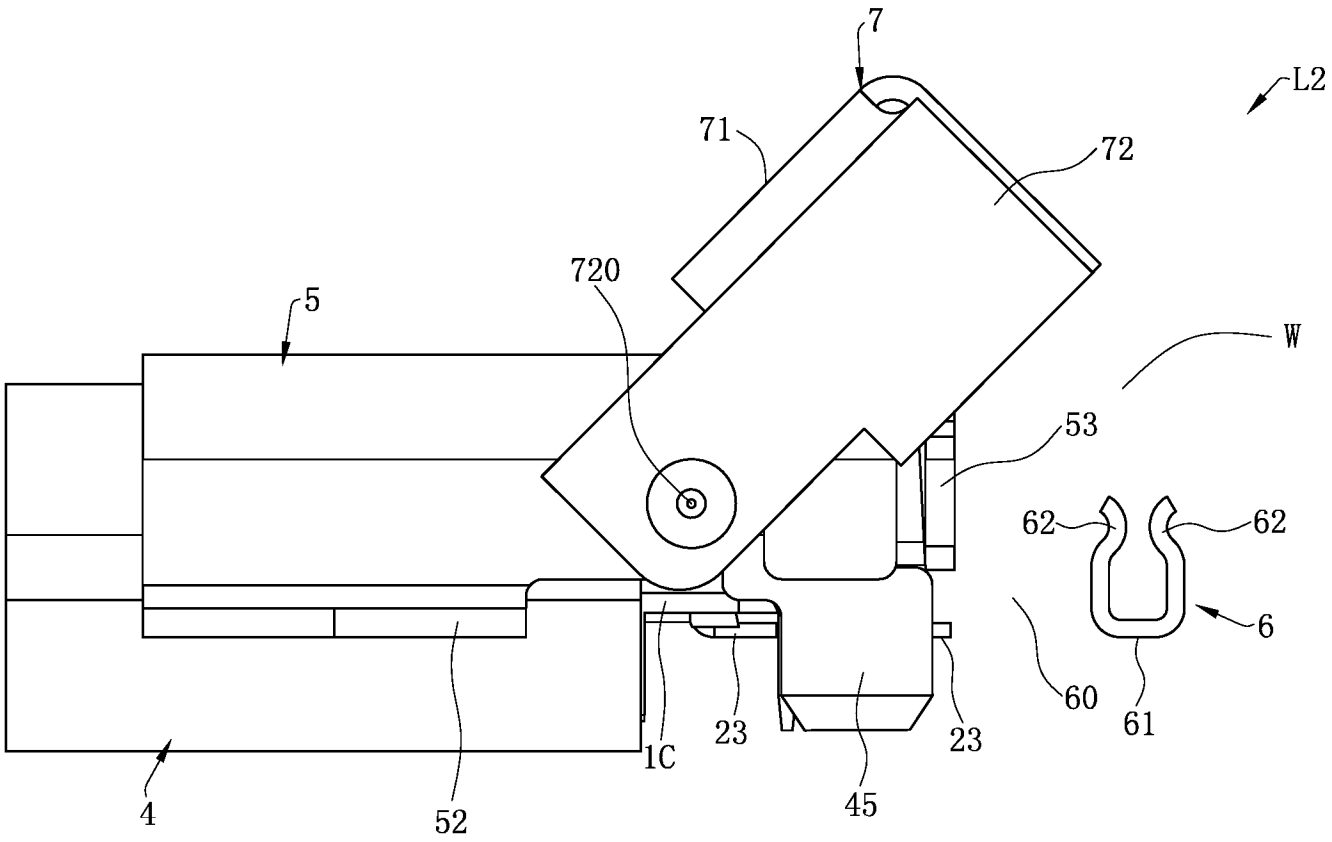
FIG. 10 is a side plain view of the electrical connector at an open position according to the first embodiment of the present invention.

Referring to FIG. 3, FIG. 4 and FIG. 10, the shielding shell 7 is movably mounted forward at a rear end of the outer metal shell 5. The shielding shell 7 has a top wall 71, two side walls 72 bending downward and extending from left and right sides of the top wall 71, and a rear wall 73 bending downward and extending from a rear edge of the top wall 71. Each side wall 72 has a pivoting portion 720. The pivoting portions 720 are respectively pivoted and matched with the pivoting holes 46, such that the shielding shell 7 may rotate relative to the insulating body 1, the inner metal shell 4 and the outer metal shell 5 in the front-rear direction to form a closed position L1 and an open position L2.

Referring to FIG. 4, FIG. 5 and FIG. 6, when the shielding shell 7 is at the closed position L1, the top wall 71 covers the upper plate 51, the top wall 71 extends backward beyond the insulating body 1 and shields an upper portion of the separation space 60, and the back plate 53 is located between the conducting portions 23 in the back row and the top wall 71. Since the shielding shell 7 rotates relative to the outer metal shell 5, there may be a clearance between the top wall 71 and the upper plate 51 when the shielding shell 7 is at the closed position L1. If there is no shielding object between the conducting portions 23 and the top wall 71, electromagnetic waves of the conducting portions 23 may leak from the clearance between the top wall 71 and the upper plate 51 to affect signal transmission of the surrounding electronic components.

Referring to FIG. 4, FIG. 5 and FIG. 6, the two side walls 72 are located outside the first pins 45 and are electrically connected with the first pins 45 through the outer metal shell 5. The two side walls 72 extend backward beyond the insulating body 1 and shield left and right sides of the separation space 60. The rear wall 73 is located behind the back plate 53 and clamped by the two matching portions 62, thereby forming electrical connection with the matching portions 62. The rear wall 73 shields a rear side of the separation space 60. The top wall 71, the two side walls 72, the rear wall 73 and the grounding medium 6 altogether enclose the separation space 60, thereby shielding the conducting portions 23 in the back row and reducing the signal interference between the terminals 2 and the electronic components around the electrical connector 100. The rear wall 73 has a notch 730 and two protruding portions 731 located at left and right sides of the notch 730. The notch 730 is located below the elastic slot 620, facilitating a shielding effect of the rear wall 73 and the grounding medium 6 on the conducting portions 23. If the elastic slot 620 is downward concavely provided to be lower than the notch 730, the notch 730 is formed opposite to the elastic slot 620 to form a leakage opening, causing signals of the conducting portions 23 to leak outside or signals of the surrounding electronic components to interfere signal transmission of the conducting portions 23 through the leakage opening. For the foregoing deficiency, the elastic slot 620 is higher than the notch 730, avoiding from the formation of the signal leakage opening, improving the shielding effect of the shielding shell 7 on the conducting portions 23, and facilitating high-frequency signal transmission. The mounting portion 61 is located in the notch 730, and the two protruding portions 731 are located at the two sides of the mounting portion 61 and downward abut the circuit board 300. A bottom surface of each conducting portion 23, a bottom surface of the mounting portion 61, a bottom surface of each protruding portion 731 and a bottom surface of each side wall 72 are all located on the same horizontal plane, facilitating an enclosing effect of the shielding shell 7 and the grounding medium 6 on the separation space 60, and reducing signal interference of the surrounding electronic components to the conducting portions 23 in the back row. A projection of each conducting portion 23 in the front-rear direction overlaps with a projection of the grounding medium 6 in the front-rear direction, improving the shielding effect of the grounding medium 6 on the conducting portion 23.

In addition, the rear wall 73 is electrically connected with the grounding medium 6, such that the current on the shielding shell 7 may be transmitted to the circuit board 300 through the grounding medium 6. It is well known to those skilled in the art that impedance of high-frequency terminals is related to a dielectric constant, distances between the high-frequency terminals and facing areas between the high-frequency terminals. However, the inventor of the present application has performed research carefully and found that capacitive induction is generated between the conducting portions 23 in the back row in the separation space 60 and each of the top wall 71, the two side walls 72 and the rear wall 73, such that the current is generated on all of the top wall 71, the side walls 72 and the rear wall 73. If there is no grounding medium 6 conducting the current on the shielding shell 7 to the circuit board 300 to form the grounding transmission path, the current on the top wall 71, the side wall 72 and the rear wall 73 may be conducted to the circuit board 300 through other grounding paths or form electromagnetic waves and diverge around. The other grounding paths may be, for example, the first pins 45 and the second pins 52. Thus, the grounding transmission path for the current on the shielding shell 7 is prolonged, which is unfavorable for signal transmission of the terminals 2. The electrical connection between the rear wall 73 and the grounding medium 6 shortens the grounding transmission path for the current on the shielding shell 7, facilitates signal transmission of the terminals 2, and also reduces the influence on signal transmission of the electronic components around the electrical connector 100.

Figure 9:
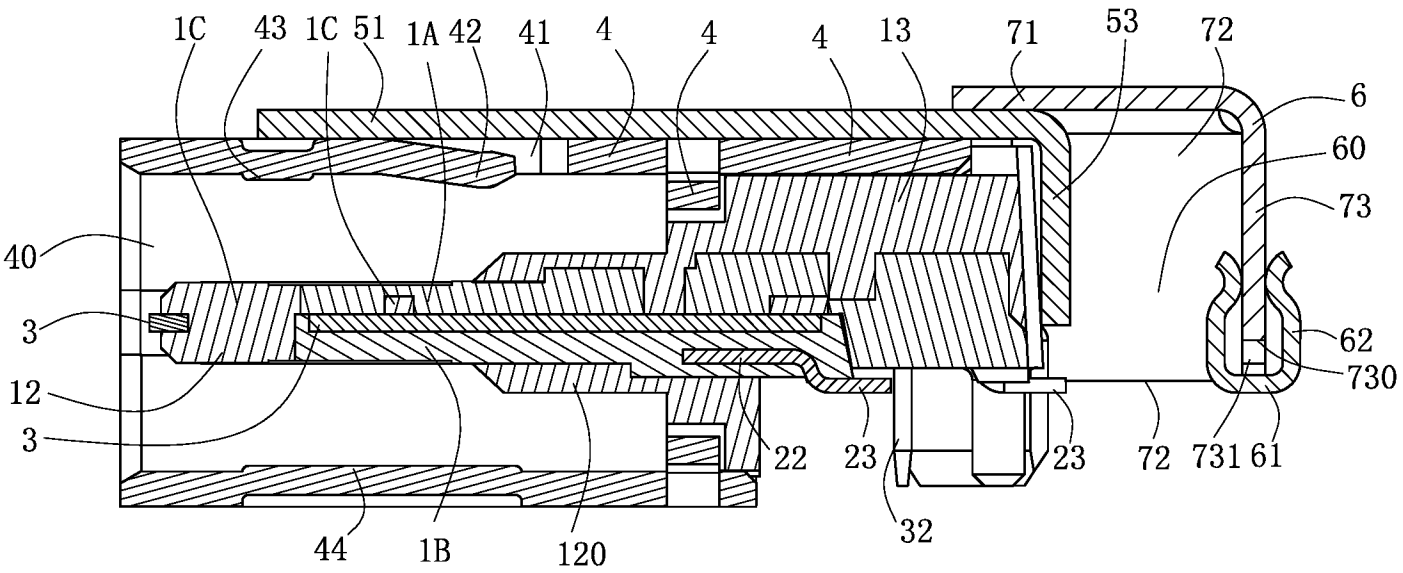
FIG. 9 is a sectional view of the electrical connector in FIG. 7 along line C-C.

Referring to FIG. 6, FIG. 7 and FIG. 9, when the shielding shell 7 is at the closed position L1, the matching portion 62 is in electrical contact with the rear wall 73 to form a contact position (not labeled), and the through hole 610 is located below the contact portion (not labeled), facilitating transmission of the current flowing to the mounting portion 61 to the circuit board 300 through an inner surface of the through hole 610 when the current of the shielding shell 7 is transmitted to the matching portion 62, and shortening the grounding transmission path. The matching portion 62, the elastic abutting arm 42 and the breaking holes 41 are located on a second vertical plane F2 in the front-rear direction. The elastic abutting arm 42 abuts the shielding shell 204. The other grounding transmission path for the current of the shielding shell 204 includes, sequentially, the elastic abutting arm 42—the inner wall of the breaking hole 41—the outer metal shell 5—the shielding shell 7—the matching portion 62—the mounting portion 61. The matching portion 62, the elastic abutting arm and the breaking holes 41 are located on the second vertical plane F2 in the front-rear direction, such that the other grounding transmission path for the current of the shielding shell 204 is located on the same vertical plane, facilitating faster transmission of the current to the circuit board 300 through the matching portion 62.

The first soldering points 54 and the two pivoting portions 720 are located on the first vertical plane F1 in the left-right direction, and the first pins 45 are located behind the pivoting holes 46. Since the shielding shell 7 may rotate upward through the pivoting portions 720, when the shielding shell 7 moves upward and away from the upper plate 51, the shielding shell 7 applies an upward acting force to the outer metal shell 5 through the pivoting portions 720. Further, the first soldering points 54 and the two pivoting portions 720 are located on the same first vertical plane F1, such that the upward acting force of the shielding shell 7 on the outer metal shell 5 and a fixation force of the inner metal shell 4 on the outer metal shell 5 are located on the same plane, facilitating stable mounting of the outer metal shell 5.

Figure 11:
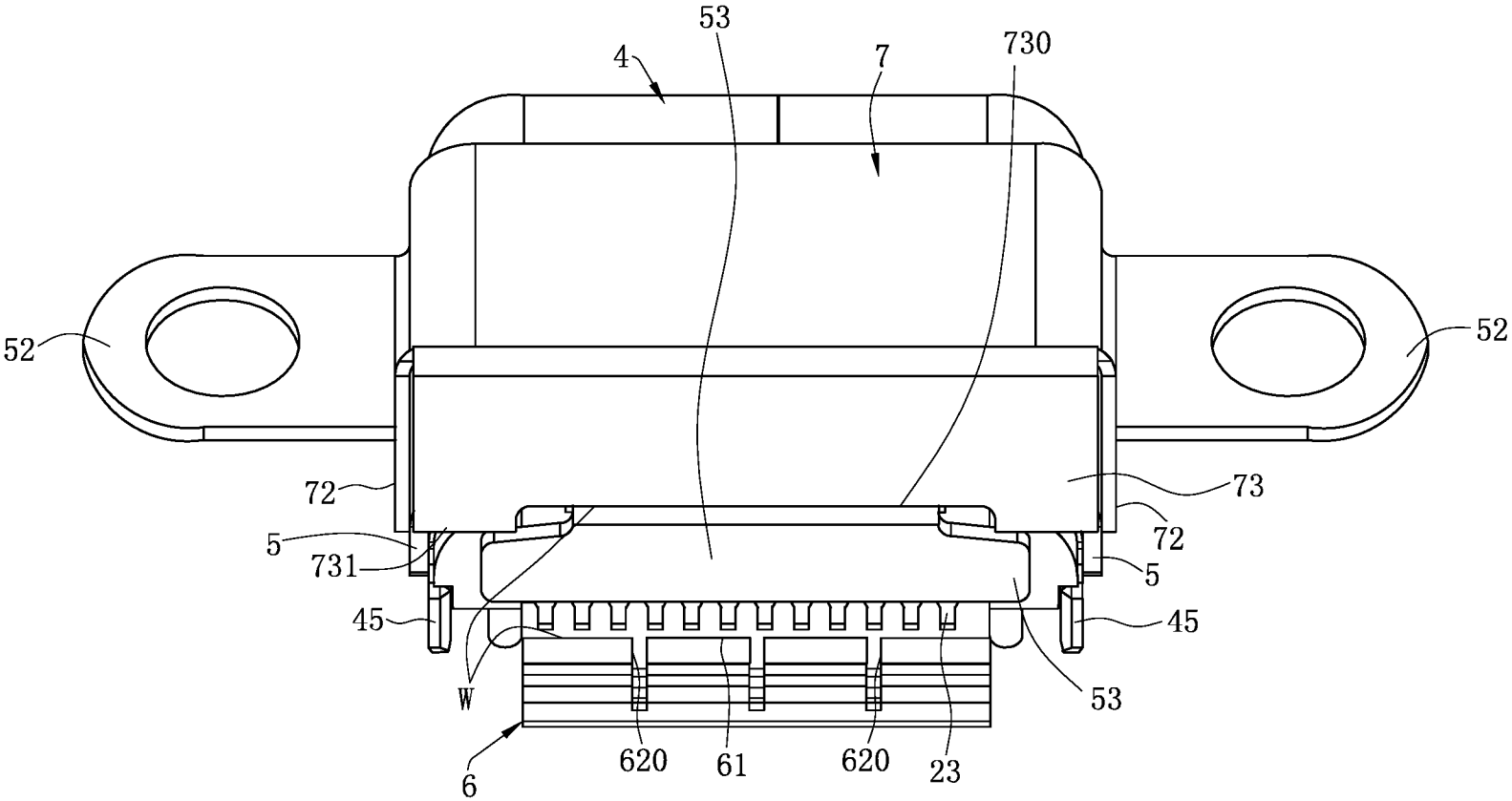
FIG. 11 is a schematic view of observation of the electrical connector along an observation window according to the first embodiment of the present invention.

Referring to FIG. 10 and FIG. 11, when the shielding shell 7 is at the open position L2, the matching portion 62 and an inner wall of the notch 730 form an observation window W, and the conducting portions 23 in the back row and the back plate 53 are exposed through the observation window W, such that the line of sight may focus on the observation window W, facilitating checking about whether the conducting portions 23 in the back row are properly soldered or not, and observation of whether the back plate 53 is mounted accurately or not may be convenient. In this embodiment, all of the conducting portions 23 in the back row are exposed through the observation window W. However, based on the actual needs, it is also implementable to adjust the size of the observation window W to mainly observe a portion of the conducting portions 23 in the back row.

Figure 12:
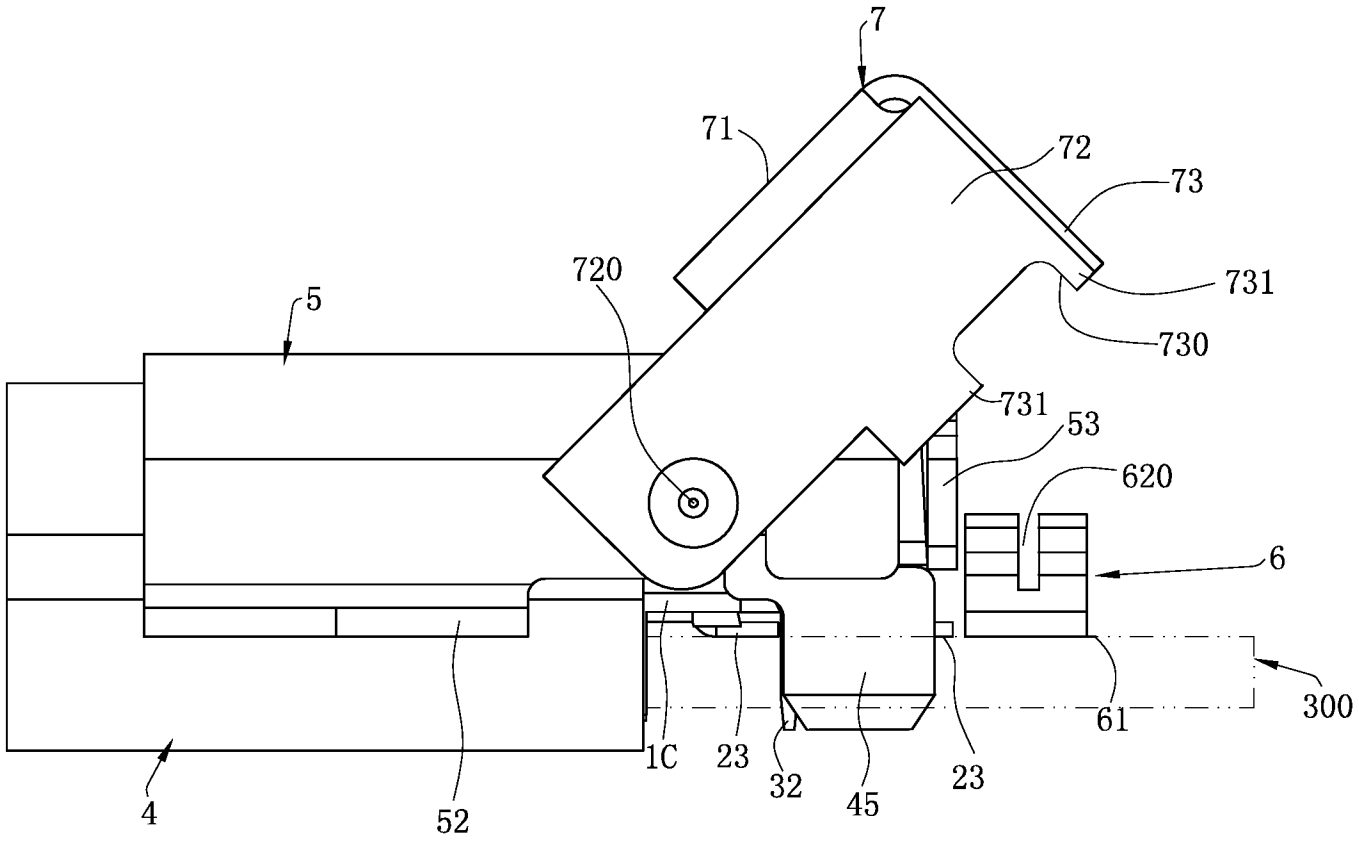
FIG. 12 is a side plain view of an electrical connector at an open position according to a second embodiment of the present invention.
Figure 13:
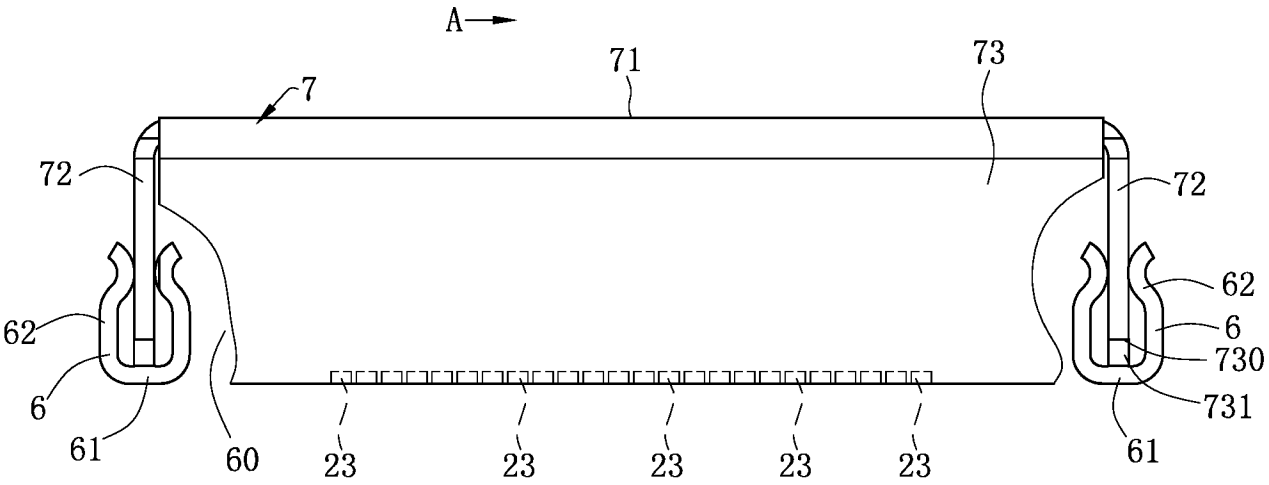
FIG. 13 is a rear plain view of the electrical connector at a closed position according to the second embodiment of the present invention.

Referring to FIG. 12 and FIG. 13, an electrical connector 100 according to a second embodiment of the present invention is shown, which is different from the electrical connector 100 according to the first embodiment in that: two grounding media 6 are provided at two sides of a rear portion of the conducting portions 23 in the back row. The grounding medium 6 at the left side is provided close to the left relative to the conducting portions 23 in the back row, and the grounding medium 6 at the right side is provided close to the right relative to the conducting portions 23 in the back row. The matching portion 62 of each grounding medium 6 is in upward electrical contact with the corresponding side wall 72. The notch 730 is upward concavely provided from a lower edge of each of the side walls 72. Meanwhile, the two protruding portions 731 located at the two sides of each notch 730 are formed. When the shielding shell 7 is at the closed position L1, the bottom surface of the rear wall 73 abuts the circuit board 300, and is located on the same horizontal plane with the bottom surfaces of the protruding portions 731 and the bottom surfaces of the conducting portions 23. Except for the foregoing differences, other features of the electrical connector 100 according to the second embodiment are identical to those of the electrical connector 100 according to the first embodiment.

Figure 14:
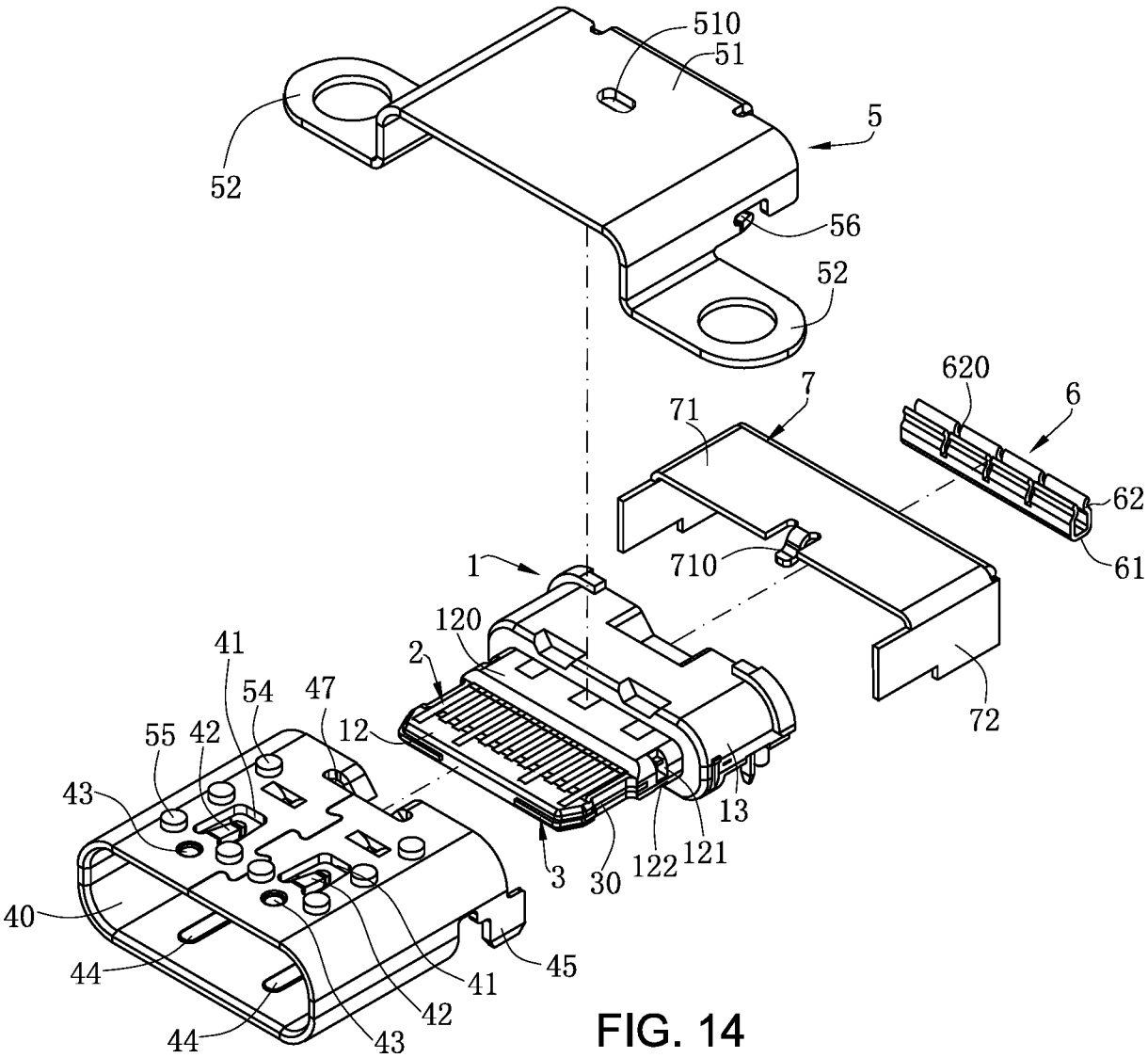
FIG. 14 is a perspective exploded view of an electrical connector according to a third embodiment of the present invention.
Figure 15:
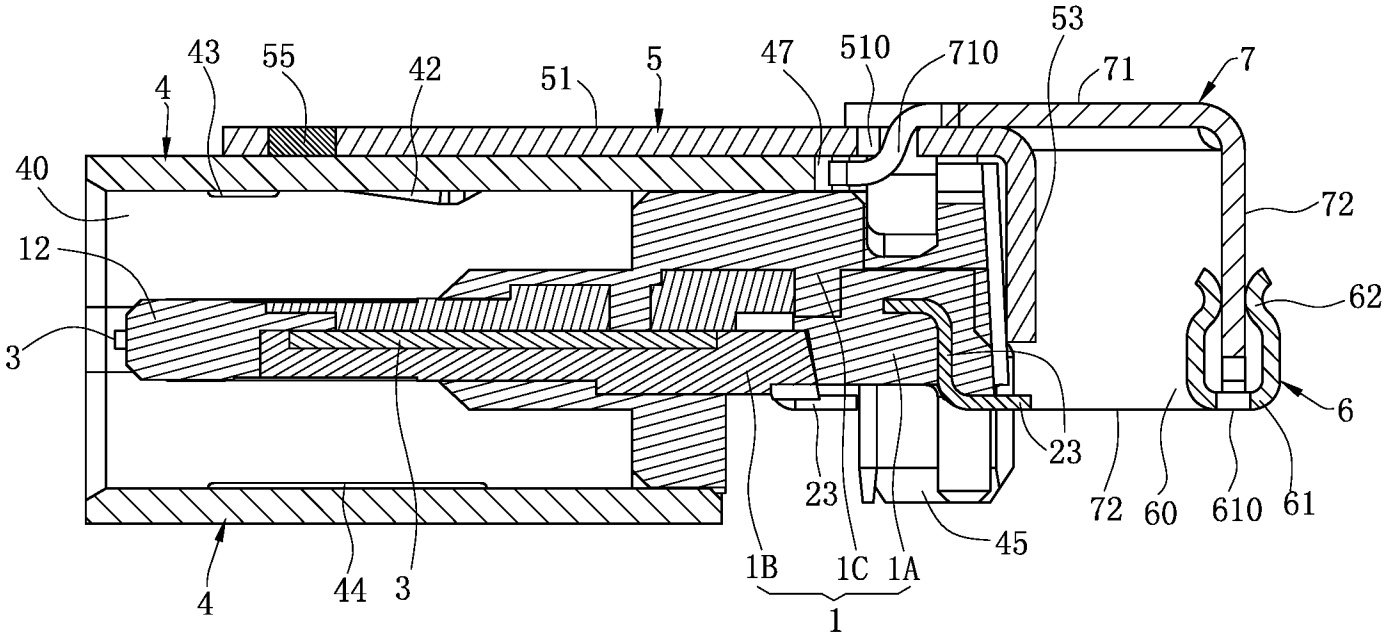
FIG. 15 is a plain sectional view of the electrical connector according to the third embodiment of the present invention.

Referring to FIG. 14 and FIG. 15, an electrical connector 100 according to a third embodiment of the present invention is shown, which is different from the electrical connector 100 according to the first embodiment in that: the side walls 72 are not provided with any pivoting portions 720, and the top wall 71 has an elastic sheet 710 extending forward and downward. The shielding shell 7 rotates along the elastic sheet 710 in the front-rear direction, and the side walls 72 is closely attached to and match with the outer metal shell 5 to limit the position of the shielding shell 7 in the left-right direction. The upper plate 51 has a first hole 510 running therethrough in the vertical direction, and the inner metal shell 4 has a second hole 47 running therethrough in the vertical direction. The elastic sheet 710 is provided across the first hole 510 downward from top thereof, and a tail end of the elastic sheet 710 is located below the upper plate 51 and accommodated in the second hole 47, such that the inner metal shell 4 and the outer metal shell 5 may limit the position of the elastic sheet 710 altogether. When the shielding shell 7 rotates along the front-rear direction, the elastic sheet 710 simultaneously rotates in the first hole 510 in the front-rear direction. Except for the foregoing differences, other features of the electrical connector 100 according to the third embodiment are identical to those of the electrical connector 100 according to the first embodiment.

To sum up, the electrical connector according to certain embodiments of the present invention has the following beneficial effects:

1. The grounding medium 6 is provided at an interval behind the conducting portions 23, and the shielding shell 7 rotates relative to the insulating body 1 between the open position L2 and the closed position L1. When the shielding shell 7 is at the open position, an observation window W is formed between a rear end of the shielding shell 7 and the grounding medium 6, and the conducting portions 23 are exposed through the observation window W, such that the line of sight may focus on the observation window W, further facilitating observation about whether the conducting portion is properly soldered or not, thereby ensuring a soldering effect of the conducting portion, and facilitating signal transmission of the terminals 2. When the shielding shell 7 is at the closed position L1, the shielding shell 7 is conductively connected with the grounding medium 6, such that a current generated at the shielding shell 7 may be conducted to the circuit board 300 through the grounding medium 6, shortening a grounding path thereof, ensuring an isolation and shielding effect of the rear end of the shielding shell 7 and the grounding medium 6 on the conducting portion, and reducing the influence between signal transmission of the terminals 2 and signal transmission of the surrounding electronic components.

2. When the shielding shell 7 is at the open position L2, the observation window W is formed between the matching portion 52 and the inner wall of the notch 730. The observation window W is formed to be similar to a rectangle, such that the line of sight may focus on the observation window W, reducing interference of the surrounding electronic components to the line of sight is reduced, and the line of sight focuses on the conducting portion 23 exposed through the observation window W, facilitating observation about whether the conducting portion 23 is properly soldered or not, ensuring the soldering effect of the conducting portion 23 and the circuit board 300, and facilitating high-frequency signal transmission of the terminals 2.

3. Two first positioning slots 121 are concavely provided on an upper surface of the step portion 120 and located at left and right sides of the step portion 120 respectively. The tail end of each upper extending arm 25 is exposed to the first positioning groove 121 at the corresponding side, such that the tail end of the upper extending arm 25 may be positioned by a tool in the secondary injection molding process, preventing the tail end from being deflected by an insulating material forming the outer injection molding member 1C. Two second positioning slots 122 are concavely provided on a lower surface of the step portion 120 and located at the left and right sides of the step portion 120, and each second positioning slot 122 is formed opposite to a corresponding first positioning slot 121 vertically. Each lower extending arm 26 is exposed in a corresponding second positioning slot 122, such that the lower extending arm 26 may be positioned by the tool in the secondary injection molding process, preventing it from being deflected by the insulating material forming the outer injection molding member 1C. Therefore, the upper extending arm 25 may firmly abut the lower extending arm 26.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, mated with a mating connector and mounted on a circuit board, the electrical connector comprising:

an insulating body;

a plurality of terminals, fixed to the insulating body, wherein each of the terminals has a contact portion and a conducting portion located behind the contact portion, the contact portion is in electrical contact with the mating connector, and the conducting portion extends out of the insulating body and is in electrical contact with the circuit board;

a grounding shell, provided to wrap outside the insulating body; and a shielding shell, rotating relative to the insulating body between a closed position and an open position, wherein a first end of the shielding shell is electrically conductively connected with the grounding shell, wherein when the shielding shell is at the closed position, a second end of the shielding shell is electrically connected with at least one grounding medium, and the grounding medium is mounted on and electrically conductively connected with the circuit board;

wherein when the shielding shell is at the open position, an observation window is formed between the shielding shell and the grounding medium, and the conducting portion of each of the terminals is exposed through the observation window.

2. The electrical connector according to claim 1, wherein the grounding medium has a mounting portion mounted on the circuit board, a matching portion extends upward from the mounting portion to be electrically connected to the second end, the second end is concavely provided with a notch corresponding to the mounting portion, and when the shielding shell is at the closed position, the notch accommodates the mounting portion.

3. The electrical connector according to claim 2, wherein the shielding shell has two protruding portions located at two sides of the notch, the two protruding portions are located at two sides of the mounting portion respectively when the shielding shell is at the closed position, and a bottom surface of the mounting portion, a bottom surface of the conducting portion of each of the terminals and a bottom surface of each of the protruding portions are located on a same horizontal plane.

4. The electrical connector according to claim 2, wherein when the shielding shell is at the open position, the observation window is formed between the matching portion and an inner wall of the notch, and the grounding shell is partially exposed through the observation window.

5. The electrical connector according to claim 2, wherein the matching portion has at least one elastic slot, and when the shielding shell is at the closed position, the elastic slot is higher than the notch.

6. The electrical connector according to claim 2, wherein the matching portion is electrically connected with the shielding shell to form a contact position, the mounting portion has a through hole running therethrough in a vertical direction, and the through hole is located below the contact position.

7. The electrical connector according to claim 1, wherein the grounding medium is provided behind the insulating body, a separation space is provided between the insulating body and the grounding medium, at least one of the conducting portions of the terminals is located in the separation space, the shielding shell has a top wall, two side walls and a rear wall, the top wall shields an upper side of the separation space, the two side walls shield a left side and a right side of the separation space respectively, the rear wall and the grounding medium altogether shield a rear side of the separation space, and the top wall, the two side walls, the rear wall and the grounding medium altogether enclose the separation space.

8. The electrical connector according to claim 7, wherein at least one of the side walls forms the first end to electrically abut and match with the grounding shell, and the rear wall forms the second end to be in electrical contact with the grounding medium.

9. The electrical connector according to claim 7, wherein the grounding shell has two first pins respectively at a left side and a right side of the grounding shell, the two first pins are located between the two side walls, and each of the first pins is electrically conductively connected with a corresponding one of the side walls.

10. The electrical connector according to claim 7, wherein the grounding shell has two conductive legs respectively at a left side and a right side of the grounding shell, and the conductive legs are located in front of the side walls and respectively at a left side and a right side of the contact portion.

11. The electrical connector according to claim 7, wherein the grounding shell has a back plate, and the back plate is located between the top wall and the conducting portions of the terminals and is configured to shield the conducting portions of the terminals at an upper side thereof.

12. The electrical connector according to claim 1, wherein two grounding media are provided and located at two sides of a rear portion of the conducting portions of the terminals, the shielding shell has two side walls provided opposite to each other in a left-right direction, a front end of each of the side walls forms the first end to be in electrical contact with the grounding shell, and a rear end of each of the side walls forms the second end to be in electrical contact with each of the two grounding media.

13. The electrical connector according to claim 12, wherein two pivoting portions are provided at the two first ends of the shielding shell, and the two pivoting portions are pivoted to a left side and a right side of the grounding shell respectively.

14. The electrical connector according to claim 1, wherein the grounding shell has an inner metal shell and an outer metal shell, the inner metal shell wraps the insulating body, the outer metal shell is provided outside the inner metal shell, and the shielding shell is provided outside the outer metal shell.

15. The electrical connector according to claim 14, wherein the inner metal shell and the outer metal shell are soldered and fixed to form at least one first soldering point, the shielding shell has two side walls at a left side and a right side of the shielding shell respectively, each of the side walls abuts the outer metal shell, and the side walls and the first soldering point are located on a first vertical plane in a left-right direction.

16. The electrical connector according to claim 14, wherein the insulating body has a tongue, the contact portion is exposed to the tongue, the inner metal shell surrounds the tongue to form an insertion space, the inner metal shell has a breaking hole, an elastic abutting arm is formed by extending from an inner wall of the breaking hole toward the insertion space to electrically abut a shielding outer shell of the mating connector, the grounding medium has a matching portion in electrical contact with the shielding shell, and the matching portion, the elastic abutting arm and the breaking hole are located on a vertical plane in a front-rear direction.

17. The electrical connector according to claim 15, wherein at least one rigid protrusion portion is formed by protruding from the inner metal shell toward the insulating body to abut a shielding outer shell of the mating connector, the outer metal shell has two conductive legs located at a left side and a right side of the contact portions of the terminals respectively, the inner metal shell and the outer metal shell are soldered and fixed to form at least one second soldering point, and the rigid protrusion portion, the conductive legs and the second soldering point are located on a different vertical plane in the left-right direction.

18. The electrical connector according to claim 14, wherein the outer metal shell has a first hole running therethrough in a vertical direction, the shielding shell has an elastic sheet extending forward, the elastic sheet is provided across the first hole downward from top thereof, a tail end of the elastic sheet is provided below the outer metal shell, the shielding shell rotates along the elastic sheet in a front-rear direction, and when the shielding shell rotates in the front-rear direction, the elastic sheet rotates in the first hole in the front-rear direction.

19. The electrical connector according to claim 18, wherein the inner metal shell has a second hole accommodating the tail end of the elastic sheet.

20. The electrical connector according to claim 1, wherein the grounding medium is located behind the conducting portions of the terminals, and a projection of each of the conducting portions of the terminals in a front-rear direction overlaps with a projection of the grounding medium in the front-rear direction.

* * * * *